United States Patent [19]

Quearry et al.

[11] Patent Number: 4,752,985

[45] Date of Patent: Jun. 28, 1988

[54] CLOSED END MOPS

[75] Inventors: Robert W. Quearry, Raytown, Mo.; Robert D. Chalfant, Atchison, Kans.; Richard W. Chalfant, Atchison, Kans.; Robert E. Liggett, Atchison, Kans.

[73] Assignee: Golden Star, Inc., North Kansas City, Mo.

[21] Appl. No.: 874,018

[22] Filed: Jun. 13, 1986

[51] Int. Cl.[4] ..... A47L 13/20

[52] U.S. Cl. ..... 15/229; 300/21

[58] Field of Search ..... 15/228, 229 R–229 BW; 300/21

[56] References Cited

U.S. PATENT DOCUMENTS

| | | | |
|---|---|---|---|
| 2,035,130 | 3/1936 | Klawans | 15/229 A |
| 2,176,095 | 10/1939 | Muckenhirn | 15/229 |
| 2,876,720 | 3/1959 | Sokoloff | 112/9 |
| 3,084,643 | 4/1963 | Caylor | 112/64 |
| 3,301,204 | 1/1967 | Chambers | 112/64 |
| 3,449,784 | 6/1969 | Moss | 15/229 |
| 3,633,975 | 1/1972 | Argeris | 15/229 R |
| 3,636,603 | 1/1972 | Moss et al. | 29/120 |
| 3,822,435 | 7/1974 | Moss | 15/229 BP |

FOREIGN PATENT DOCUMENTS

| | | | |
|---|---|---|---|
| 50-29585 | 9/1975 | Japan . | |
| 55-36527 | 9/1980 | Japan . | |
| 1434415 | 5/1976 | United Kingdom | 15/229 BP |

*Primary Examiner*—John M. Jillions
*Assistant Examiner*—Lynn M. Sohacki
*Attorney, Agent, or Firm*—Wm. Bruce Day

[57] ABSTRACT

Mops and process for making closed or uncut end mops particularly using single ply cotton yarn having a high degree of twist. The yarn is processed through a fringe making machine into lengths of pre-sewn fringe and the high twist yarn tends to bunch together in thick, ropy masses of yarn strands. The fringe is affixed to mop backs to form a mop, and the mops are then soaked in a high temperature water bath until the ropy yarn strands relax, straighten and separate. The mops are rinsed and transferred to a high temperature hot air dryer and dried until the separate yarn strands twist about their looped ends to form separate, individual doubled ply yarn strands with uncut ends.

4 Claims, 2 Drawing Sheets

Fig. 1.
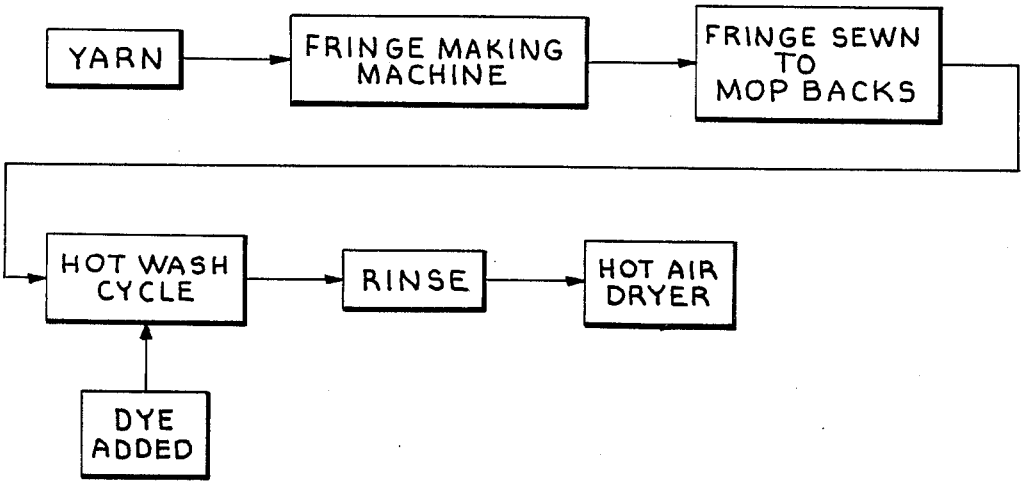
Fig. 2.
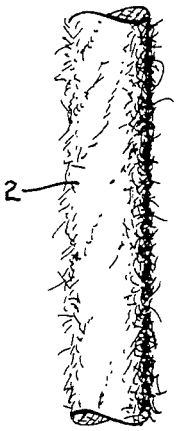
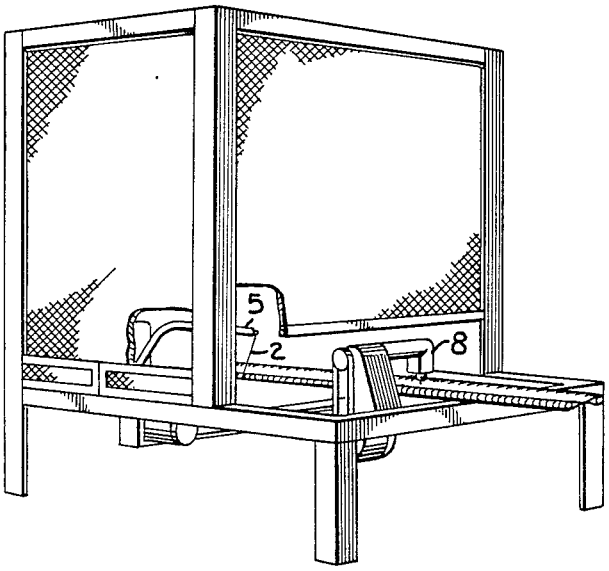
Fig. 3.
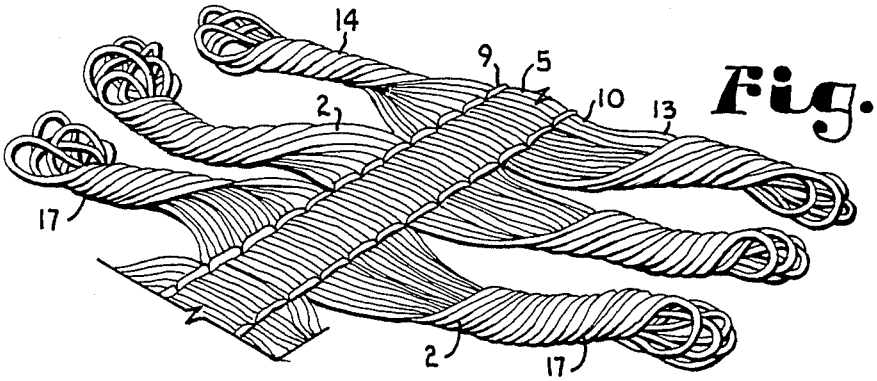
Fig. 4.

Fig. 5.
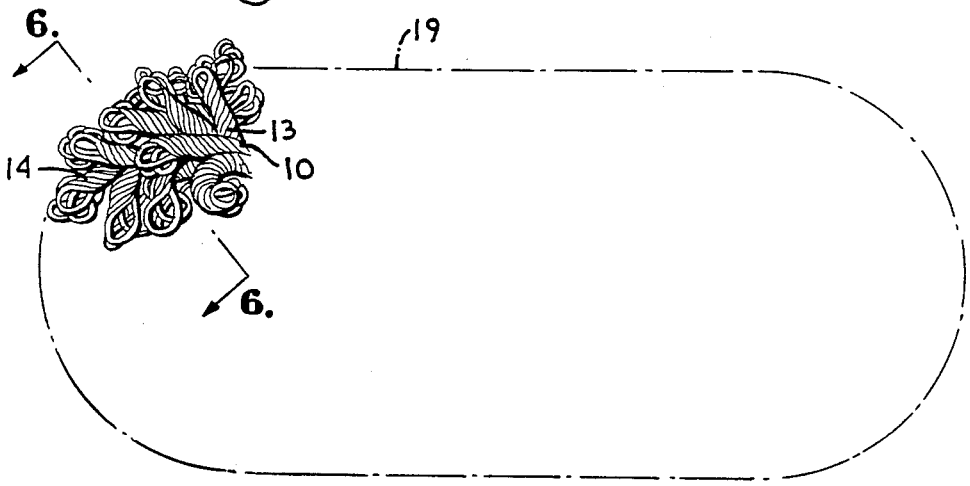
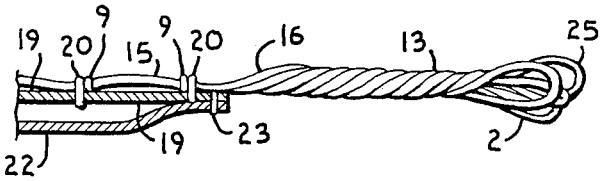
Fig. 6.
Fig. 8.
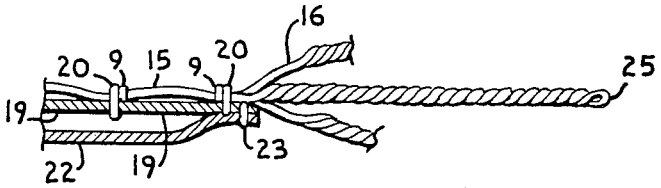
Fig. 7.
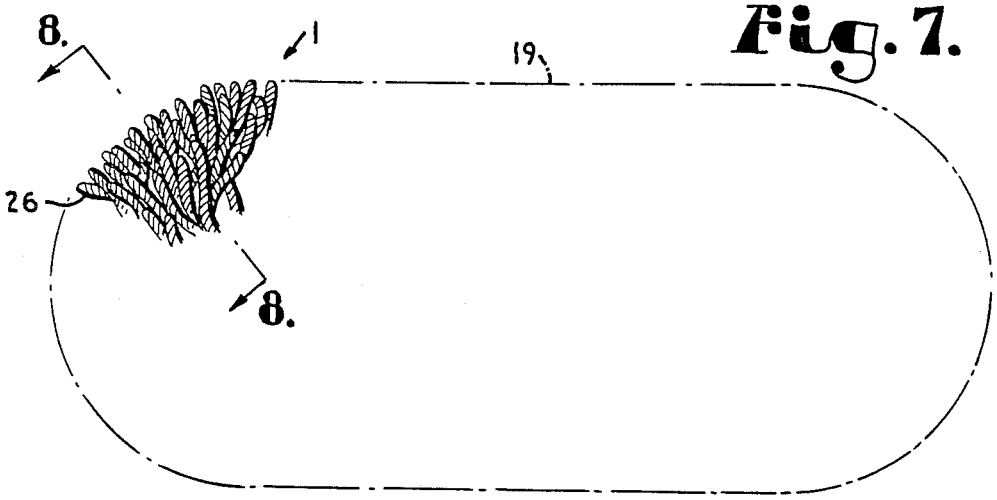

CLOSED END MOPS

FIELD OF THE INVENTION

This invention relates to mops for janitorial and cleaning purposes, and in particular, to mops and a certain process for making closed end mops.

BACKGROUND OF THE INVENTION

At least for the last one hundred years, a common problem in the mop industry has been to manufacture mops, whether they be wet mops, dry mops or dusters, so that the mops withstand extended usage and do not excessively fray or lint off. For many years mops were generally either wet mops or the so-called oil mop. The latter was usually a triangular arrangement with either looped or cut end yarns and which was soaked in oil to better attract dust and impart a sheen to the surface of a wood floor. The wet mops were used for the heavier mopping tasks and had to withstand loading with soapy water and scrubbing at solid areas on the floor. The predominate enemy of both these types of mops was moisture, whether the moisture be in the form of water or oil, because the moisture tended to fill the intersticial openings in the mop yarns, thereby causing separation of the fibers, and generally made the mop yarn heavier, causing the fibers to tend to separate longitudinally. The results was linting during use, which left unsightly streaks upon the finished floor, and accumulation of lint balls that collected under furniture and provided breeding places for alergen producing molds, mites and fungi.

With the 1950's and the decline of the oil finished wood floor came the rise of dry mops, or the typical elongate, flat janitor's mop now in common use on the terrazzo, tile or otherwise hard finished floor of commercial establishments, gymnasiums and the like. The janitor's mop needed washing afer each use to remove the accumulated dust and dirt and this spurred the growth of the mop rental industry. Under a typical arrangement, a rental agency would buy mops from a manufacturer and would provide a clean, fresh mop to janitorial service businesses at the start of each night's clean up. Because the mop was frequently washed, it became imperative that the mop be able to withstand the cleaning process without the mop yarns unraveling and turning to a linty, fibrous mass during washing. Because the rental business purchased the mops from the manufacturer and distributed them nightly, the inducement was clear to provide a mop which could withstand sufficient washings to recoup the initial purchase investment and to provide a reasonable profit to the rental business, as well as being a product that the janitorial service would accept as an effective mopping tool.

As a result of the effort to construct a mop able to withstand repeated washings and still provide effective cleaning capability, several approaches were taken. One course was to make the mop yarns of a synthetic material. Previously, mop yarns had been all cotton, which was favored for low cost, ability to hold water or oil and its ability to attract and pick up dust. Cotton fibers were generally not very durable and various synthetics, such as saran, nylon, rayon and the like were introduced in varying proportions with the cotton fibers to form the yarns. The difficulty with the synthetic fibers is that generally the synthetic fibers do not provide the water absorbency and dust gathering qualities of the all cotton yarns and are often harsh to feel, signaling to the perspective purchaser that, while the mop might better withstand repeated washings, its effectiveness as a cleaning tool might be degraded.

Another avenue of approach came in the recognition that cut ends of the mop yarns were the places that permitted the yarn to untwist, bloom and lint off. That recognition lead to the expansion of the use of looped end yarns, which had begun at least as early as the 1880's. These looped ends kept the mop yarns intact longer by retaining the yarn twist and did not provide the bloomed cut ends which often readily shed lint.

Rug and mop manufacturers have attempted to alleviate the problems associated with the use of cut end yarns by a tufting process in which a yarn pile is formed by needles which penetrate a backing. However, tufting machinery is expensive, and the tufting process is more suited to large run activities where wide expanses of yard goods must be covered with yarn pile, such as in rugs or carpeting, rather than short and small run, often odd shaped mops.

Mops have often been made by a pre-sewn fringe technique. One such machine for making pre-sewn fringe is disclosed in the Feighery et al. U.S. Pat. No. 3,299,844. Such machines usually include a winding arm which revolves about yarn carriers that are generally in the form of spaced, parallel bars about which chains travel. The winding arm wraps the yarn about the yarn carriers and the chains move the wrapped links of yarn toward the exit of the machine. A sewing head is situated between the arms and stitches the wrapped yarn so that it comes off the machine in long lengths of pre-sewn fringe. This fringe is then used in individual strips, or coiled concentrically onto backings to form various types of mops, whether it be hand mops, dry mops or buffing pads.

The instant invention involves a particular construction of mop and a process for making pre-sewn yarn, and ultimately mops, using a particular formation of yarn and in treating such yarn so that the yarn forms closed, looped ends and which yarn resists linting and is highly durable in use.

OBJECTS OF THE PRESENT INVENTION

The objects of the present invention are: to provide such a mop which is resistant to linting and highly durable in use; to provide such a mop which is able to withstand repeated washings without decomposing into a mass of fibers; to provide such a mop which may be composed of all cotton yarns for low cost, water retention and dust holding properties; to provide such a mop which may be dyed through the below described process for color coding; to provide such a mop having discreet strands of closed end yarn; and to provide such a mop which is relatively inexpensive, sturdy and efficient in use and particularly well adapted for the intended purpose.

Other objects and advantages of this invention will become apparent from the following description taken in connection with the accompanying drawings wherein are set forth, by way of illustration and example, certain embodiments of this invention.

DESCRIPTION OF THE DRAWINGS

FIG. 1 is a diagrammatic view of the steps of the process of the instant invention.

FIG. 2 is a plan view, greatly enlarged, of a mop yarn used in the manufacture of the instant invention.

FIG. 3 is a perspective view of a yarn pre-sewing machine used in the instant process.

FIG. 4 is a perspective view of a length of pre-sewn yarn as it comes from the yarn pre-sewing machine.

FIG. 5 is a plan view of a mop formed using the pre-sewn yarn of FIG. 4.

FIG. 6 is a sectional view taken along lines 6—6, FIG. 5.

FIG. 7 is a plan view of a mop made in accordance with the instant invention.

FIG. 8 is a sectional view taken along lines 8—8, FIG. 7.

DESCRIPTION OF THE PREFERRED AND ALTERNATE EMBODIMENTS

As required, detailed embodiments of the present invention are disclosed herein, however, it is to be understood that the disclosed embodiments are merely exemplary of the invention which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference number I, FIG. 7, generally indicates a mop made in accordance with the present invention. The mop is generally formed of lengths of pre-sewn yarn fringe affixed to a backing in the particular shape of the desired configuration of mop. As used herein, the term "mop" refers to the range of typical products of the mop industry, that is; dusters, triangle mops, swabs, buffer pads and the like. In FIG. 7 is shown a mop having the configuration of what is generally termed a janitor's mop, meaning a dry mop which is elongate, generally rectangular or oval, and which is maintained rigid by a frame attached to a mop handle or stick.

The process of making the mop shown in FIG. 7 is described generally with respect to FIG. 1. By the present invention, yarn, such as shown in FIG. 2, is processed in a fringe making machine, such as shown in FIG. 3, to produce a pre-sewn fringe, FIG. 4, that is then affixed to a mop back, FIG. 5. The semi-finished mops shown in FIG. 5 are subjected to a hot wash process, to which dye may be added, then rinsed and dried in a hot air dryer under the conditions specified below.

The yarn used, FIG. 2, is preferably an all cotton, short, staple yarn known in the trade as 2s-1 wherein the grade is specified as 22s and 1 refers to single ply yarn. The yarn 2 is a spun yarn and may be formed by either open end spinning or ring spinning processes, however it has been found that open end spun yarns are preferable for the instant use.

The yarn 2 is produced at the mill and specified with a high degree of twist. Accordingly, the yarn 2 is of particular and peculiar specification in that at least six and preferably seven twists per inch is used. This is considered an extremely high degree of twists in the industry, because the normal amount of twists per inch for mop yarns has heretofore been about three twists per inch with the maximum number of twists per inch previously known for use being five twists per inch. The high number of twists per inch is desired and necessary to give the yarn sufficient twist to rebound tight enough when the process of the instant invention is completed. Thus, the yarn is made at the mill pursuant to an unusual and believed unique specification and is wound on cones for further use in the manufacturing process. High twist yarn has heretofore been considered unmanageable and unsuitable for use.

The yarn is processed through a pre-sewn fringe machine 4, FIG. 3. These machines are well known in the art and a typical one employs a winding arm 5 which revolves at high speed and lays down a wrapping of yarn 2 on a conveyor 6 of some type. Various conveyors have been used to move the wrapped yarn from the proximity of the winding arm 5 to an outlet 7 of the machine and include such arrangements as screws or parallel, bar mounted chains. A sewing head 8 is commonly placed in the conveyor pathway and between the conveyor drive arms to place a line of stitches 9 medially of the length of fringe.

A pre-sewn yarn fringe 10 emerges from the outlet 7 of the fringing machine 4 and is configured to have opposite bights 13 and 14 and a collapsed central section 15 bound by the stitching 9. The fringing machine 4 tends to lay in the yarn limbs 16 substantially side-by-side and with the yarns forming continuous uncut or closed ends. With the high degree of twists, such as seven twists per inch, the yarns 2, as the fringe 10 emerges from the machine 4, tends to bunch together in unruly, thick, ropy masses 17 composed of multiple limb lengths of the single ply yarn 2 and with multiple looped ends.

Next, FIG. 5, the pre-sewn yarn fringe 10 with the yarn ropy masses 17, are sewn in a desired pattern, such as a continuous coil, concentric circles, or parallel rows, to a mop back 19 of desired shape. Sewing is normally done by hand wherein the sewer positions the strip of fringe 10 as necessary and machine stitches the fringe 10 to the back 19 in a line of stitching 20. After attaching the fringe 10 to the mop back 19, a pocket web 22 may be affixed, as by stitching, to the mop back 19 by a line of stitching 23 at the selvage for fitting mop holder brackets or frames.

After the various stitching and assembly operations, the mop is complete except for the remaining processing. The mop is clearly not in a condition for effective use and the mop would not sell with the unruly and ropy masses 17 of yarn 2. These masses do not provide sufficient floor coverage, would tend to leave streaks, and would not provide an effective cleaning tool.

Next, the mop, with the fringe 10 attached, is processed through a high temperature wash cycle water bath until the masses of yarn strands relax, straighten and separate. This process includes washing in large volumes of hot water at approximately 160 gallons of water per 100 pounds of mop, or fringe. The intention is to provide sufficient hot water so that the mops float freely in the bath and the water completely penetrates all of the ropy masses 17. The temperature of the water is extraordinarily high for normal washing, such as at a temperature of 160° to 170° F., and at least 160° F., and the time of the wash substantially longer than normal, such as for at least forty-five minutes. Within reason, the longer the wash cycle, the better. This long wash cycle at high temperature using large volumes of water causes the ropy masses 17 to uncoil and relax, whereby the side-by-side single ply yarns tend to separate into discreet loops of single ply yarn 2 having opposite limbs 16 and a looped end 25.

During the hot wash cycle, dye may be added to the water bath to custom color the mops for various purchasers and/or identify sizes or particular lines of mops.

Thus, dying can be accomplished at the mop manufacturing plant as an integrated step in the manufacture process. Because manufacture necessitates a hot water bath, a separate dying operation is not required and substantial savings are achieved. Heretofore, yarns were purchased from the yarn mill dyed as requested in a special and expensive process. Under the present procedure, yarns can be purchased undyed from the yarn mill, processed into pre-sewn yarn fringe 10, sewn to the mop back 19, processed through the hot wash and dyed therein.

After the hot wash cycle, the wash water is extracted, such as by centrifuging, and the mops undergo a cool water rinse cycle, also with approximately 160 gallons of water per one hundred pounds of mop or fringe. The rinse water is extracted and the mops taken to a dryer.

At the point the mops or fringe are taken to the dryer, the twisted masses 17 have separated so that the yarns 2 hang singly with opposite limbs and looped ends 25 and are separate from their adjoining yarns of the same configuration. The mops or fringe is then dried in a hot air dryer at high temperature until the yarns shrink and retwist, or recoil, about the individual uncut or looped ends 25 to form individual, effectively at least two-ply strands of yarn with uncut ends, FIG. 8. Preferably, the mops or fringe are dried for approximately thirty minutes at about 220° F. to cause the twist to again set to form effective two-ply, uncut end strands and then dried until dry at a temperature of at least 180° F.

The result is as shown in FIGS. 7 and 8, wherein the finished mop 1 exhibits a pre-sewn yarn fringe of individual, doubled, effectively two-ply yarn strands 26 which are composed of single ply yarns twisted about a single uncut or looped end 25 and without twisting about adjacent yarn strands 26. The yarn strands 26 may fall loosely over each other, FIG. 7, but are not twisted about adjoining doubled strands to approach the configuration of the yarns in the ropy masses 17, FIG. 5.

Although the invention has been generally described with 2s-1 yarn for the sake of brevity, multiple ply yarn may also be used. In these instances, the multiple ply yarns also have at least six twists per inch, form ropy masses when processed through the fringing machine, and recoil and double about a looped end after the wash and dry process. For example, suitable results have been obtained using two-ply yarns, which separate and recoil double to form effective four-ply strands with looped ends. Further, satisfactory results have occurred with as much as four-ply yarn, though the resultant effective eight-ply yarn strand is unusually thick for normal mop products.

In all of these constructions, the configuration of significance is that, the high twist, single or mulitple ply yarn has been transformed from an unusable, ropy mass to a highly effective looped end single yarn strand mop. The high degree of twist returns after washing and drying to cause only the individual strands, either single ply or multiple ply, to recoil and double as separate strands in a degree of tightness that inhibits linting and fiber breakdown, either in use or during washing.

It is to be understood that while one form of this invention has been illustrated and described, it is not to be limited to the specific form or arrangement of parts herein described and shown, except insofar as such limitations are included in the following claims.

What is claimed and desired to be secured by Letters Patent is as follows:

1. A mop comprising:

(a) a backing material of a selected mop form configuration;

(b) lengths of pre-sewn yarn fringe affixed to said backing material; and (c) said pre-sewn yarn fringe being of at least a single, continuous coiled, helical winding of yarn strand, said yarn strand having a high degree of twist of at least six twists per inch, said yarn strand being formed into looped ends with limbs extending therefrom and laid into said fringe substantially side-by-side, and doubled back and entwined to form individual, separate, at least two ply doubled yarn strands.

2. The mop set forth in claim 1 wherein:

(a) said yarn strand has a high degree of twist of approximately seven twists per inch.

3. A mop comprising:

(a) a backing material of a selected mop form configuration;

(b) lengths of pre-sewn yarn fringe affixed to said backing material; and (c) said pre-sewn yarn fringe formed of at least a single, continuous coiled, helical winding of, single ply yarn strand, said yarn strand having a high degree of twist of approximately six to seven twists per inch, said yarn strand being formed into looped ends with limbs extending therefrom and laid into said fringe substantially side-by-side, and doubled back and entwined to form individual, separate, two ply doubled yarn strands.

4. A mop comprising:

(a) a backing material of a selected mop form configuration;

(b) lengths of pre-sewn fringe affixed to said backing material; and (c) said pre-sewn yarn being at least a single, continuous, coiled, helical winding of yarn strand, said yarn strand having a high degree of twist of at least six twists per inch, collapsed substantially centrally, said yarn strand being formed into multiple looped ends with limbs extending therefrom and laid into said fringe substantially in side-by-side parallel relationship where said fringe is affixed to said backing material, and doubled back and entwined to form individual, separate, doubled yarn strands.

* * * * *